United States Patent [19]

Casson, Jr. et al.

[11] 4,166,777

[45] Sep. 4, 1979

[54] CORROSION RESISTANT METALLIC PLATES PARTICULARLY USEFUL AS SUPPORT MEMBERS FOR PHOTO-LITHOGRAPHIC PLATES AND THE LIKE

[75] Inventors: Edward A. Casson, Jr., Easton, Md.; Albro T. Gaul, Matawan, N.J.; Eugene L. Langlais, Detroit, Mich.; Gerald Shadlen, Arnold, Md.; Eugene L. Vanaver, Dallas, Tex.

[73] Assignee: Hoechst Aktiengesellschaft, Frankfurt, Fed. Rep. of Germany

[21] Appl. No.: 859,244

[22] Filed: Dec. 9, 1977

Related U.S. Application Data

[60] Continuation of Ser. No. 697,199, Jun. 17, 1976, abandoned, which is a continuation of Ser. No. 609,236, Sep. 2, 1975, abandoned, which is a continuation of Ser. No. 231,767, Mar. 3, 1972, abandoned, which is a division of Ser. No. 811,267, Jan. 21, 1969, Pat. No. 3,658,662.

[51] Int. Cl.[2] ..... C25D 11/06; C25D 17/00

[52] U.S. Cl. ..... 204/28; 204/58; 204/206

[58] Field of Search ..... 204/28, 58

[56] References Cited

U.S. PATENT DOCUMENTS

| | | | |
|---|---|---|---|
| 2,512,563 | 6/1950 | DeLong | 204/56 M |
| 2,578,400 | 12/1951 | Cohn | 204/58 X |
| 2,780,591 | 2/1957 | Frey | 204/23 |
| 3,330,743 | 7/1967 | Jestl et al. | 204/33 |
| 3,632,486 | 1/1972 | Herrmann et al. | 204/33 |

FOREIGN PATENT DOCUMENTS

| | | | |
|---|---|---|---|
| 721675 | 3/1932 | France | 204/58 |
| 840012 | 4/1939 | France | 204/58 |
| 1043094 | 9/1966 | United Kingdom | 204/58 |

*Primary Examiner*—F. C. Edmundson
*Attorney, Agent, or Firm*—Hauke and Patalidis

[57] ABSTRACT

A process for electrolytically forming on a metallic element a protective layer or film in an electrolyte consisting of an aqueous solution of preferably sodium silicate or alternately of other salts rendering the electrolyte substantially basic, the metallic element constituting the anode in the process. The processed metallic element has particular usefulness as a support member for photolithographic printing plate, the electrolytically formed film acting as a barrier layer preventing deterioration of the light sensitive diazo resin, or the like, utilized as a photosensitive coating on lithographic plates.

6 Claims, 10 Drawing Figures

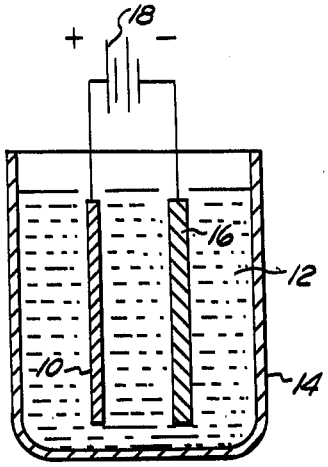
FIG. 1
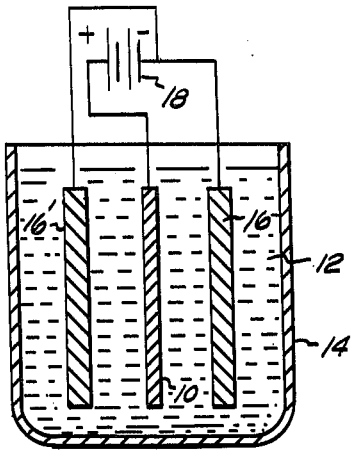
FIG. 2
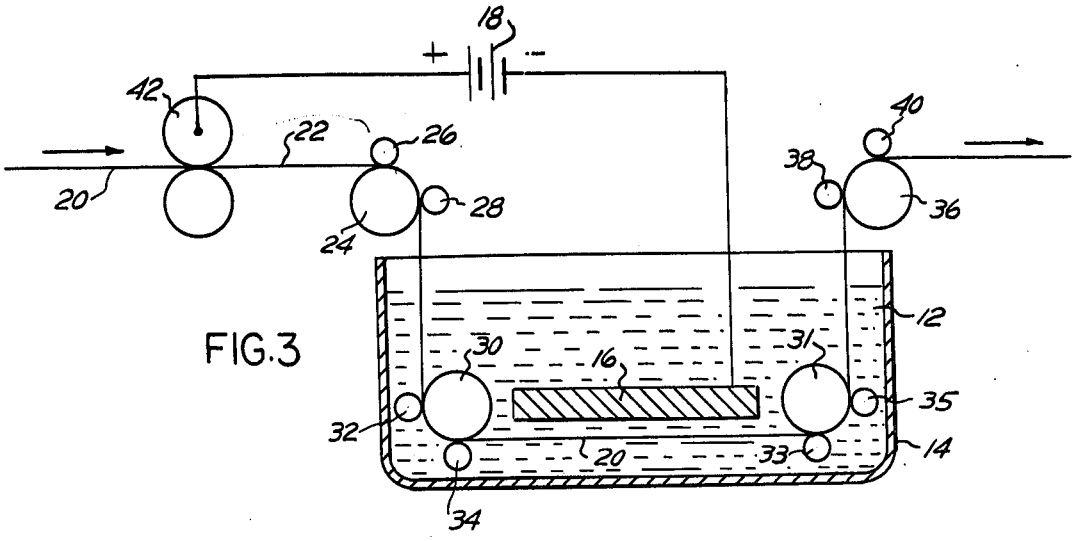
FIG. 3
FIG. 4
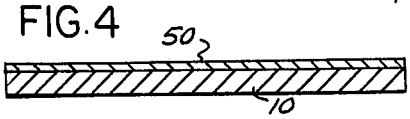
FIG. 5
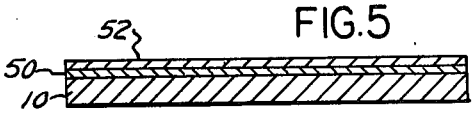
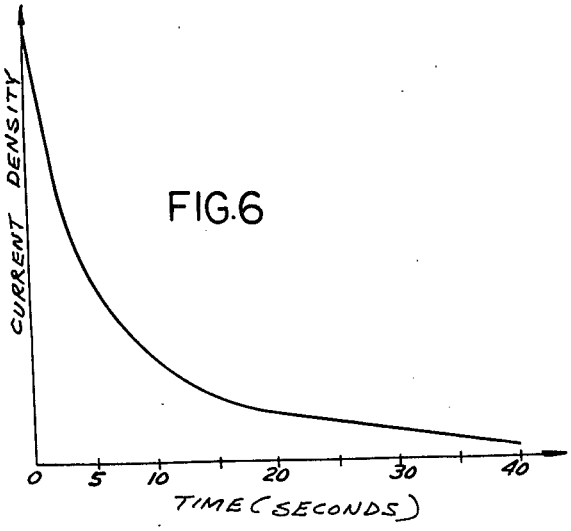
FIG. 6
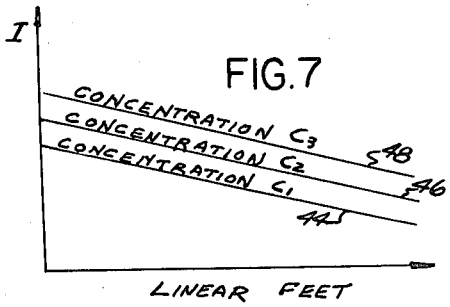
FIG. 7

CORROSION RESISTANT METALLIC PLATES PARTICULARLY USEFUL AS SUPPORT MEMBERS FOR PHOTO-LITHOGRAPHIC PLATES AND THE LIKE

This is a continuation of application Ser. No. 697,199, filed June 17, 1976, which is a continuation of application Ser. No. 609,236, filed Sept. 2, 1975 which is a continuation of application Ser. No. 231,767, filed Mar. 3, 1972, all three of which are now abandoned, the last being a divisional application of Ser. No. 811,267, filed Jan. 21, 1969, now U.S. Pat. No. 3,658,662.

BACKGROUND OF THE INVENTION

1. Field of the Invention

The present invention belongs to the field of methods and processes for forming on the surface of metallic elements a protective layer which is corrosion resistant, which acts as a barrier layer preventing spontaneous interreaction between the material of the element and a coating disposed thereon, and which is endowed with specific physical characteristics or qualities different from those of the base material. Although products obtained by way of the present invention have a general usefulness as a result of being provided with a corrosion and electrical resistant surface film they are particularly useful as support members for photo-lithographic plates and the like.

The protective surface layer is obtained by an anodic electrolytic process.

2. Description of the Prior Art

Photo-lithographic plates currently in use today often include a metallic support member, having, for example, aluminum as its principal component, a surface of which has been silicated by chemical methods to provide a barrier layer which prevents interreaction between the photosensitive diazonium salts, or other photosensitive and non-photosensitive coatings, placed upon the support member and the metal surface of the support member. Silication of the metal surface provides a chemical pacification which increases the shelf life of the lithographic plate, facilitates the processing of the plate after exposure, and improves the length of the printing run and the quality of print. The barrier layer is obtained, according to the prior art, by subjecting the metallic surface to the action of a solution of one or several of a plurality of compounds, examples of which include hydrolized cellulose ester, sodium phosphate glass, alkali metal silicates, sodium metaborate, phosphomolybdate, sodium silicate, silicomolybdate, water-soluble alkylated methylomelamine formaldehyde, polyalkylene-polyaminemelamine-formaldehyde resins, urea-formaldehyde resin plus polyamide, polyacrylic acid, polymethacrylic acid, sodium salts of carboxymethylcellulose, carboxymethylhydroxyethyl-cellulose, zirconium hexafluoride, etc.

An often used solution in the prior art is an aqueous solution of sodium silicate in which the metallic plate, forming the lithographic plate support member, is dipped, or which is applied to a surface of the plate. The solution is preferably heated before dipping the plate therein or before applying to the surface of the plate, and the plate surface is optionally washed with an acidic medium in order to harden the silicated surface and neutralize any alkali that may remain on the surface.

In addition to acting as a barrier layer between the metal of the metallic plate and the diazo resin, the silicated surface forms a hydrophilic surface which partially acts as an initial water-carrying surface when the processed plate is placed in a printing press. The hydrophilic surface thus formed is desirably relatively insoluble in the fountain solutions used in a printing press in order to prevent undercutting or hydration of the image areas.

It has been postulated that the following reactions take place during conventional silication of an aluminum surface:

(1) The aluminum and the aluminum oxide at the surface of the plate react with the solution according to the formulae:

$$Al + 2OH \rightarrow AlO_2 + H_2 \quad (a)$$

$$Al_2O_3 + 2OH \rightarrow 2AlO_2 + H_2O \quad (b)$$

(2) Silication, simultaneously or consecutively, takes place at the surface, according to the following formula:

$$Al + AlO_2 + SiO_3 \rightarrow (Al_2SiO_5)2x$$

The aluminum silicate surface layer thus formed is substantially insoluble, although it may be dissolved to some extent in strong reagents, and it has been postulated that it is in the form of large super crystals having an endless chain-like structure as follows:

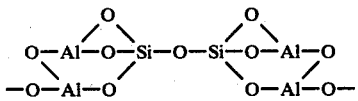

However in addition to aluminum silicate, other compounds may be formed and included in the surface layer, which often result in differences in the qualities of the surface layer. Some of the compounds that may be present in the film of aluminum silicate including $Al(OH)_3$, hydrated $Al_2O_3$, and hydrated sodium aluminum silicate, such as, for example, $Na_2O.Al_2O_3.2SiO_2.6H_2O$, could present varied degrees of solubility in fountain solutions used on printing presses. In addition, if varied cations such as Ca, Mg, etc., are present, they may also form complex double silicates with the aluminum, which may cause further loss in quality of the formed layer.

Silication of aluminum plates by the processes of the prior art requires control of the purity of the solution and of the process variables as closely as feasible, such process variables being the pH of the solution, the concentration of silicate, the temperature of the solution, the duration of the operation, the amount of grain of the plate, the plate surface cleanliness, the degreasing or dismutting processes utilized, etc. If all the process variables are closely controlled in the prior art processes, it is possible to obtain silicated aluminum plates of acceptable quality for use as support members for photo-lithographic plates. The most important of the desirable qualities to be achieved consist in an adequate chemically inert surface layer which does not deteriorate with age and is uniform and well bonded to the aluminum base material and which protects the aluminum surface in such manner that it is prevented from interreacting with the acidic diazo resin and will be only slowly etched by the acidic fountain solutions, and in providing an appropriate anchorage for the light exposed diazo resin which permits the developing lacquer to build up on the image areas and to supply long lasting oleophilicity of the image areas, thus insuring long runs of the plate in the printing press. Such qualities are difficult to obtain in a repetitive manner by way of the processes of the prior art.

The present invention, by contrast, by utilizing an electrolytic process for forming an improved functional surface on aluminum plates and other metallic elements permits to achieve consistent and repetitive quality in the surface and permits to obtain a surface greatly enhancing the quality of photo-lithographic plates as compared to what is achieved by prior art methods.

SUMMARY OF THE INVENTION

The present invention provides an electrolytic process for forming on the surface of a metallic plate, such as is generally used as a support member for a coating of diazonium salts or the like in photo-lithographic plates, a pacified, corrosion resistant, hydrophilic surface layer greatly enhancing lithographic and printing performances.

Although silication obtained by prior art methods provides a barrier layer between the metallic plate and the diazonium salt compounds or the like utilized as the photosensitive coating in photo-lithographic plates, electrolytically formed surface layers according to the present invention provide barrier layers which are much improved as far as lithographic hardness, continuity and uniformity of the layers or films is concerned. The electrolytic process of the present invention also produce surface layers which are intimately bonded to the underlaying materials, which have high hydrophilic qualities and provide a practical improvement in the fine grain of the plate surface. In addition, the electrolytically formed surface layer has a much improved anchoring quality for adhesion of the diazo resin thus reducing any tendency to image failure and resulting in improved runs. The improved surface grain and the increase in bonding quality of the electrolytically treated surface also result in more retained diazo, more retained lacquer and a more oleophilic image, leading to longer running and higher quality press performances, as compared to conventional lithographic plates.

Other advantages provided by surfaces obtained by the method of the present invention to photo-lithographic plates, cylinders, rollers, and other support members are less propensity to attack from the printing press fountain solutions, less soluble film remaining on the plate after rinsing, improved hydrophilic quality on the surface, and a more compact film resulting in a lithographically harder surface and less deterioration as a result of wear. The hard, compact surface film or layer obtained by the present invention on a metallic element, because of its corrosion resistant characteristics, its bonding and anchoring qualities with respect to a decorative or protective film which may subsequently be applied thereto and its increase in electrical resistivity as compared to the resistivity of the base material, results also in providing articles having general usefulness in the industry.

These and other advantages and objects will become apparent to those skilled in the art when the accompanying description of some of the best modes contemplated for practicing the invention is read in conjunction with the accompanying drawings wherein like reference numerals refer to like or equivalent parts.

BRIEF DESCRIPTION OF THE DRAWINGS

FIG. 1 is a schematic representation of an example of arrangement for practicing the electrolytic process of the present invention;

FIG. 2 is a schematic representation of a modification of the arrangement of FIG. 1;

FIG. 3 is a schematic representation of a further modification of the arrangement of FIG. 1, illustrating a continuous line process;

FIG. 4 is a schematic sectional view of a metallic plate having been subjected to the process of the invention;

FIG. 5 is a schematic sectional view of the metallic plate of FIG. 4 provided with a coating of photo-sensitive material such as a diazo resin or the like;

FIG. 6 is a chart representing the current flow as a function of time in a typical example of operation according to the electrolytic process of the present invention;

FIG. 7 is a chart representing a family of curves of the current flow, at diverse electrolyte concentrations, as a function of the linear feet of metallic plate strip electrolytically processed according to the arrangement of FIG. 3;

DETAILED DESCRIPTION OF THE PREFERRED EMBODIMENTS

Figure 8:
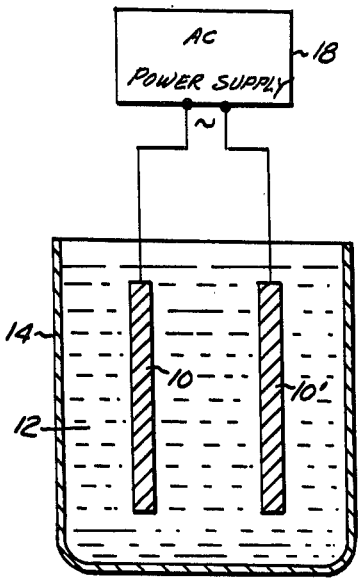
FIG. 8 is a schematic representation of another example of arrangement for practicing the electrolytic process of the present invention.

In order to practice the present invention, a metallic element such as a metallic plate 10, as shown in FIG. 1, is dipped in an appropriate electrolyte 12, contained in a tank 14, in proximity to an electrically conductive electrode 16. The metallic plate 10 is connected to the positive terminal of a DC power supply 18, and the electrode 16 is connected to the negative terminal of the power supply, such that the metallic plate 10 is electrolytically anodic and the conductive electrode 16 is electrolytically cathodic. The conductive electrode 16 may be in the form of a solid metallic plate, or in the shape of a grid or mesh made of the same material as the metallic plate 10, or made of a dissimilar material.

The DC power supply 18 may be a bank of storage batteries, an AC-DC dynamo-electric or static converter, an AC-DC rectifier or any other convenient source of DC power. A pulsed DC current power supply may be used, and it does not seem material whether the DC voltage across the terminals of the power supply is constant and steady or include an AC ripple. An AC power supply may be also used, which is arranged to operate on that portion of the cycle when the metallic element 10 is substantially anodic.

EXAMPLE I

Plates of 1100 aluminum, having an area of 25 sq. in. and 0.009 in. thick were prepared by having a surface of a continuous web of the aluminum material grained at a line speed of 12 feet per minute using a sand slurry. The web was then cut so as to provide plates of the indicated area. The plates were electrolytically silicated according to the arrangement of FIG. 1, by dipping the plate in the electrolyte at a predetermined distance from a cathode 16 consisting of a stainless steel grid, the grained surface of the plate being disposed opposite the cathode. The spacing between the plate and the cathode was three inches in a series of runs and six inches in another series of runs, and experiments were run with an electrolyte solution consisting of an aqueous solution of diluted "Star Brand" 42° Baume sodium "silicate" defined as (1 $Na_2O$: 2.5 $SiO_2$), sold by Philadelphia Quartz Co., the concentration of "silicate" in the solution being equivalent to 1.56% of "silicate" by weight in a series of runs and 4.05% of "silicate" by weight in another series of runs, having a pH of approximately 13 in both cases. The conditions of operations, namely the voltage applied across the plate and cathode, the time or duration of operation, the spacing between the plate and the cathode, the concentration of silicate in the electrolyte, and the temperature of the electrolyte are tabulated hereinafter together with the relatve quality rating of the samples.

It will be appreciated that percents of silicate by weight as mentioned herein refer in each instance to the percent solids of "silicate" as defined hereinbefore.

TABLE I

| Sample No. | Voltage (Volts) | Time (Sec.) | Spacing (In.) | Electrolyte Concentration (% weight) | Electrolyte Temperature (°C.) | Relative Rating |
|---|---|---|---|---|---|---|
| 4 | 36 | 10 | 6 | 1.56 | 20 | Poor |
| 4' | 6 | 60 | 3 | 4.05 | 20 | Poor |
| 2 | 36 | 60 | 6 | 1.56 | 20 | Poor |
| 1 | 6 | 60 | 6 | 1.56 | 20 | Fair |
| 5 | 36 | 30 | 3 | 1.56 | 20 | Fair |
| 3 | 36 | 30 | 6 | 1.56 | 20 | Fair |
| C | 36 | 60 | 6 | 1.56 | 50 | Fair |
| B | 36 | 30 | 6 | 1.56 | 50 | Good |
| C' | 36 | 60 | 6 | 1.56 | 50 | Good |
| 1' | 36 | 10 | 6 | 4.05 | 20 | Good |
| 5' | 6 | 60 | 6 | 4.05 | 20 | Good |
| 3' | 36 | 60 | 3 | 4.05 | 20 | Good |
| 2' | 36 | 60 | 6 | 4.05 | 20 | Excellent |
| A' | 6 | 60 | 6 | 4.05 | 50 | Excellent |
| A | 36 | 10 | 6 | 1.56 | 50 | Excellent |
| D | 6 | 60 | 6 | 1.56 | 50 | Excellent |
| B' | 36 | 30 | 6 | 4.05 | 50 | Excellent |

After silication, the silicated surface of each sample was coated with a conventional diazo resin, according to conventional methods in the lithographic plate manufacturing industry. The diazo resin used for all the tests mentioned herein was Diazo Resin No. 4, manufactured by Fairmount Chemical Co. The sample plates were exposed and developed by means of a one-step developer which developed the image at the same time as it lacquered it.

The relative qualitative rating of the sample plates resulted from lacquer "breakdown" tests. After the first development of the image, the one-step developer was reapplied so as to redissolve the lacquer and relacquer the image. The procedure was repeated until the image broke down and did not relacquer. In the "poor" category were those sample plates which broke down at the first redevelopment, which is the case for the lower quality conventionally silicated plates silicated generally at low temperature. The "fair" category includes sample plates which withstood two or three redevelopments, which is generally comparable to plates which are conventionally silicated at high temperature. The "good" category includes sample plates which were redeveloped five or more times, while the "excellent" category includes plates which were even better. It will be appreciated that the "breakdown" test utilized for the relative qualitative rating, although commonly used in the lithography industry, is far from being an objective or scientific test, dependent as it is upon the human tester's technique and skill, but such a test when effected by the same person upon a plurality of samples, permits to obtain a substantially reliable relative rating.

Even the sample plates included in the "poor" category as far as the breakdown tests were concerned yielded good quality images and in some other aspect were superior to the average conventional lithographic plates. The sample plates did not scum up and they did not yield any black spots, which are common defects in conventionally silicated plates.

Table I indicates that the best results are achieved with a relatively high temperature of electrolyte and with a relatively high voltage, in the neighborhood of 36 volts. With reduced voltage, longer times in the electrolyte bath are required.

Tests were also run with an electrolyte having a concentration of 0.5% by weight or less. It was found that with such low concentration of silicate in the electrolyte it becomes difficult, if not impossible, to obtain a silicated layer in a reasonable time. This may be due to the fact that the electrolyte does not contain a high enough concentration of silicate or hydroxide anions to react at the surface of the aluminum plate. When sufficient silicate and hydroxide anions are present in the solution as a result of utilizing higher silicate concentrations in the electrolyte, the anions forced to the positively charged aluminum plate are able to react to form a film which may be a complex aluminum silicate. An increase in the voltage and in the temperature of the electrolyte not only produce superior results but permit shorter times in the electrolyte bath which are advantageous in continuous coil manufacturing processes, as will be hereinafter explained. Experimentally it was found that electrolyte concentration between 0.5% and 15% by weight, applied voltage between 6 and 60 volts DC, temperature of the electrolyte between about 20° C. and the boiling temperature of the electrolyte and time of immersion between 10 and 360 seconds yield a good quality silicated layer on the plate.

Other concentrations of the electrolyte solution may be effectively used, up to saturation, depending upon the particular silicate or other salt used in the electrolyte and the temperature of the bath.

High concentrations reduce immersion time requirements. For example, in one pair of tests, immersion time was decreased from 60 seconds to 5 seconds by increasing the concentration from 1.95% to 3.75%. Very high concentrations, for example 37% by weight of a 2.5 $SiO_2/Na_2O$ ratio, have lower electrical conductivity which must be taken into account. Very high concentrations do react with the aluminum both before and after the electrolytic treatment and should therefore be used with appropriate care. Although the test results of Table I were obtained with a silicate containing a $SiO_2$ to $Na_2O$ ratio of 2.5, it is obvious that other ratios may be used. For example silicate solutions having a $SiO_2$ to $Na_2O$ ratio of 2.65 and 2.84, made by Diamond Alkali Co., were successfully used.

Other voltages and temperatures than the preferred ranges hereinbefore indicated may also be used, all of such variables being readily determinable by a reasonably skilled operator and, depending on the particular requirements, quality standards and available equipment.

It has been determined that rinsing of the electrolytically treated plate is desirable. Rinsing is relatively more difficult after long immersion times or other process combinations which produce a similar effect. It should however not be concluded that such surfaces are inferior in quality and performance.

Other salts which may also be included in the electrolyte, in addition to sodium silicate, include metal silicates, phosphates, chromates, borates, vanadates and molybdates. These and other constituents when used alone or in combination in electrolyte solutions, instead of sodium silicate, in practicing the present invention, are propounded as accomplishing the same or equivalent results in varying degrees of effectiveness.

It should be appreciated that the process of the invention differs from anodization. Anodization utilizes acid electrolyte solutions only as a current conductive medium and the anions in the electrolyte serve no permanent role in the surface composition obtained. In aluminum anodization, for example, it is sought to obtain $Al_2O_3$, even though $SO_4$, or $C_2O_4$ anions may be used in the acidic electrolyte. In the present invention, the anions being displaced to the anodic plate appear to become an integral part of the surface produced. Basic anodic processes are not generally used. An example of a research study, (Briggs et al., Trans. Faraday Soc., 51, 1433, (1955), 52 1272 (1956)), related to Nickel-Iron and Nickel-Cadmium battery processes describe oxidation of Nickel in alkaline solutions.

The electrolytic process of the present invention preferably utilizes a basic electrolyte and results in electrochemically pacifying the surface such that the surface becomes resistant to corrosion and dissolution and also produces a base film suitable for anchorage. This is clearly demonstrated by electrolytically forming a surface, as previously indicated, on an aluminum plate according to the arrangement of FIG. 1, and in monitoring the electrical current flowing through the electrolyzing circuit. Keeping the voltage constant, the current flow as a function of time follows the curve shown at FIG. 6. It can thus be seen that after a predetermined period of time, of several seconds, the current flowing through the electrolyte is reduced to a fraction of the original current.

If it is desired for some applications, generally other than photo-lithographic applications, to provide both surfaces of a metallic element or plate with a passive silicated surface layer, the arrangement of FIG. 2 may be used wherein the metallic plate 10 is disposed in the tank 14 containing an appropriate electrolyte 12 between two cathodes 16 and 16'.

Referring now to FIG. 3 there is schematically illustrated a continuous electrolytic process for forming on a surface of a continuous metallic web 20 a layer according to the present invention. The web 20, made for example of aluminum foil which has been preferably pregrained on a surface 22 thereof, is deflected by means such as rollers 24, 26 and 28 into a tank 14 containing an electrolyte 12, for example, a sodium silicate aqueous solution as previously mentioned. By means of rollers 30, 32 and 34, and rollers 31, 33 and 35, the continuous web 20 is caused to be linearly displaced in the tank 14 in proximity to an electrode 16, the grained surface of the web being opposite the electrode. In a photo-lithographic plate manufacturing continuous process, the web emerging from the tank 14 is fed by further rollers 36, 38, 40 to rinsing and drying stations and to a diazo coating station, not shown, and to a station, not shown, where the web is sectioned in any appropriate lengths.

The electrode 16 is connected to the negative terminal of a DC power supply 10 so as to be cathodic, while the continuous web 20 is rendered anodic by being connected to the positive terminal of the DC power supply 18 by means such as a current conductive roller 42, or by any other appropriate means, including by way of example but not limitation, brushes, sliding contacts, or the like.

EXAMPLE II

A web of 1100 aluminum, 29½ in. in width, was silicated according to the arrangement of FIG. 3 utilizing an electrolyte heated above 70° C. and consisting of an aqueous solution of sodium silicate ($1Na_2O:2.5SiO_2$) containing 3.10% by weight of sodium silicate, the cathode being spaced 4 inches from the moving web and the cathode extending 10 feet along the length of the web. A voltage of 31 volts was used, and the aluminum web was continuously pregrained at a line speed of 12 feet per minute using a sand slurry. A total current of 240 amps flowed in the electrical circuit at the beginning of the silication operation and progressively reduced to 180 amps after 1145 linear feet of the web had passed through the bath.

It seems that the decrease in current flowing through the electrolyte is the combined result of a progressive reduction of effective surface area of the web due to wear of the abrasive particles is the slurry used for graining the surface thereof, and due to an apparent depletion and/or contamination of the electrolyte. Consequently, the decrease in current flowing through the electrolyte may be used as a means for monitoring the effect of surface area and electrolyte effectiveness in a continuous manufacturing process.

The decrease in current as a linear function of the amount of linear feet travelling through the electrolyte bath is represented at FIG. 7 by curve 44 corresponding to an electrolyte concentration of C1. With an electrolyte concentration of C2, C2>C1, and in the concentration range where increase in concentration results in increased conductivity, the current flowing through the electrolyte as a function of the linear feet of web passing through the electrolyte is according to curve 46, while at still a higher concentration C3, the current flow is according to curve 48.

An increase in the velocity of displacement of the web through the electrolyte bath causes an increase of the current flowing through the electrolyte, as tabulated in Table II.

TABLE II

| Ft/min | Current (amp.) | Temperature (° C.) | Voltage (volts) |
|---|---|---|---|
| 9 | 174 | 83 | 30 |
| 12 | 184 | 83 | 30 |
| 15 | 194 | 83 | 30 |
| 18 | 205 | 83 | 30 |

The results of Table II can be foreseen from the curve of FIG. 6 and from what has been hereinbefore explained as the electrolytic process of the present invention is partly self-limiting and results in only a leak current flowing through the electrolyte as soon as an appropriate silicated surface has been formed.

Experiments were conducted in which the metallic element 10 of FIG. 1 and the electrode 16 were connected to the terminals of a DC power supply in such manner that the metallic element 10 was connected to the negative terminal of the power supply so as to be cathodic while the electrode 16 was connected to the positive terminal of the power supply so as to be anodic, all other conditions being the same as mentioned relatively to Example I hereinbefore. Under such conditions, no surface layer having the desirable properties was obtained on the metallic element 10.

As previously mentioned, it is immaterial whether the voltage applied across the metallic element and the electrode has any AC ripple. As a matter of fact, the principles of the present invention apply to arrangements wherein a metallic element connected to a terminal of an AC power supply is disposed in an appropriate electrolyte bath in which is immersed another electrode which may be either a dissimilar or a similar metallic element connected to the other terminal of the Ac power supply. On application of an AC voltage, the metallic element is anodic for approximately each half cycle of applied voltage. Such arrangement is shown in FIG. 8 wherein a tank 14 contains an appropriate electrolyte 12 in which is immersed a metallic element 10 connected to a terminal of an AC power supply 18. An electrode formed by a dissimilar or similar metallic element 10' is connected to the other terminal of the power supply. The apparatus functions with greater electrical efficiency when both metallic elements 10 and 10' are workpieces to be provided with a protective layer. If element 10' is a dissimilar electrode, power is dissipated without useful performance when such electrode is anodic with respect to the workpiece, metallic element 10.

EXAMPLE III

Utilizing the arrangement of FIG. 8, metallic elements 10 and 10' being both plates made of 1100 aluminum alloy were immersed in an electrolyte consisting of an aqueous solution of 6.5% by weight of sodium silicate solution of $SiO_2$: 2.5 $Na_2O$ maintained at a temperature of 25° C. The two plates were disposed five inches apart in the electrolyte and were connected across an AC power supply providing a 60 cycle, 60 volts RMS potential, for a duration of operation of 30 seconds. A surface layer was formed on the opposing faces of both plates, such surface layer having excellent properties, at least as good as the properties obtained by the arrangement of FIG. 1 using a DC power supply. The surface layer formed had a purplish blue color which turned slightly greyer after rinsing with clear water. The surface layers obtained on aluminum by the DC processes of the present invention are also generally blue in coloration, although they lose more of their coloration after rinsing.

In addition to permitting to obtain surface layers having qualities at least equivalent to the layers obtained by way of the DC electrolytic process of the present invention, the use of an AC power supply has the added advantage of simplification of the power supply, of allowing more flexibility in placement of the electrodes and, in providing a process wherein both electrodes consist of metallic elements whose surfaces are sought to be provided with protective surface layers.

Figure 9:
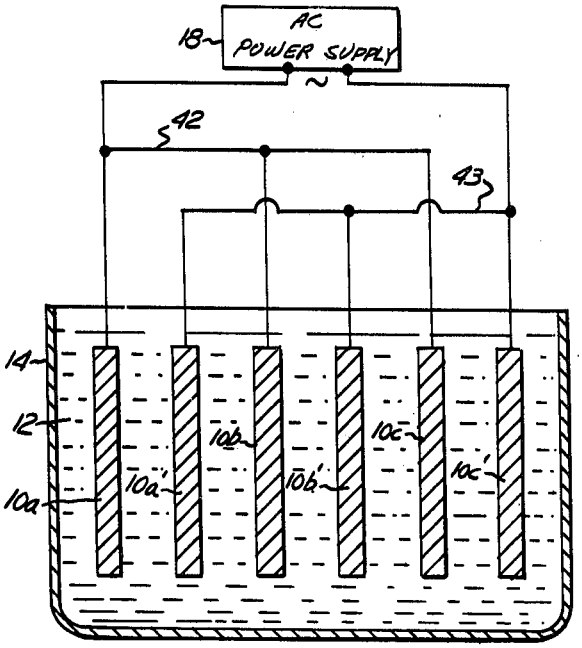
FIG. 9 is a schematic representation of a modification of the arrangement of FIG. 8.

If it is desired to provide both faces of a metallic element with a surface layer according to the present invention, utilizing an AC power supply, the arrangement schematically shown in FIG. 9 may be utilized. A plurality of metallic elements **10*a*, 10*b*, 10*c*, etc., are electrically connected in parallel by means of a line 42 connected to a terminal of an AC power supply 18. A plurality of similar metallic elements 10*a'*, 10*b'*, 10*c'* etc., are connected in parallel by means of a line 43 to the other terminal of the power supply. In such manner, all the metallic elements with the exception, in the arrangement of FIG. 9, of the extreme elements are provided on both faces with a protective surface layer. It is obvious that, for example, the tank 14** may be a circular tank of appropriate dimensions such that an even number of plates are disposed in the electrolyte in the tank, all the odd numbered plates being connected in parallel to a common terminal of the power supply and all the even numbered plates being connected in parallel to the other terminal of the power supply. It will be appreciated that such an arrangement may be automated with an appropriate fixture on which the plates are mounted and which is dipped, after loading, into the electrolyte tank, the power supply being turned on for the appropriate time, then turned off, and the fixture removed from the electrolyte.

EXAMPLE IV

Samples of 1100 aluminum having an area of 4 square inches, 0.009 in. thick and having a surface grain obtained by the method mentioned with respect to Example I, were electrolytically treated according to the arrangement of FIGS. 1 and 8 to establish a comparison between the results achieved by the DC and AC processes of the present invention. The "cathode" was stainless steel unless otherwise indicated. The spacing between "cathode" and "anode" was four inches in a series of runs and one inch in another series of runs. The temperature of the electrolyte solution was 26° C. and it consisted of an aqueous solution of 6.5% by weight of sodium silicate of the ratio $1Na_2O:2.5SiO_2$. The duration of the electrolytic operation was forty seconds for one series of runs and two seconds for another. Comparisons were made using DC, AC and full wave (FW) rectified AC power supplies. These data as well as a relative quality rating are tabulated hereinafter.

TABLE III

| Test No. | Voltage (volts) | Type | Electrode Spacing (in.) | Time (sec) | Rel. Rating |
|---|---|---|---|---|---|
| 1 | 9 | AC | 4 | 40 | Excellent |
| 2 | 18 | AC | 4 | 40 | Excellent |
| 3 | 36 | AC | 4 | 40 | Excellent |
| 4 | 9 | AC | 1 | 40 | Excellent |
| 5 | 18 | AC | 1 | 40 | Good |
| 6 | 36 | AC | 1 | 40 | Good |
| 7 | 9 | FW | 4 | 40 | Good |
| 8 | 36 | FW | 4 | 40 | Excellent |
| 9 | 9 | FW | 1 | 40 | Excellent |
| 10 | 36 | FW | 1 | 40 | Excellent |
| 11 | 9 | DC | 4 | 40 | Good |
| 12 | 36 | DC | 4 | 40 | Excellent |
| 13 | 9 | DC | 1 | 40 | Excellent |
| 14 | 36 | DC | 1 | 40 | Excellent |
| 15 | 36 | AC | 4 | 2 | Excellent |
| 16 | 36 | FW | 4 | 2 | Excellent |
| 17 | 36 | DC | 4 | 2 | Excellent |
| 18 | 36 | AC | 4 (both Al electrodes) | 2 | Good |
| 19 | 36AC+50DC | DC biased AC | 4 | 2 | Excellent |

The relative quality rating was obtained from the same breakdown test described with respect to Example I herein. Table III indicates that, at the electrolyte concentration indicated and for 40-second electrolytic operation durations, voltages within the 9–36 volt range either DC, AC, or full wave rectified can be used to produce good to excellent plates at 26° C. However, even for two-second durations, using 36 volts, good to excellent plates can be produced using the indicated concentration, with little or no difference between DC, AC and other wave form electrical power.

EXAMPLE V

Plates of 1100 aluminum as described in Examples I and III were electrolytically treated in an electrolyte consisting of an aqueous solution of 6.5% by weight of sodium silicate of ratio 1 $Na_2O$:2.5 $SiO_2$ at 25° C. and at 75° C., at various AC voltages using aluminum as both electrodes for a series of runs whose conditions of operation and results are tabulated in Table IV, and platinum as one of the electrodes in another series of runs. It was noted that the current drops rapidly when two aluminum electrodes are used but not when a platinum electrode and an aluminum electrode are used. Samples were produced at intervals from 30 to 220 volts AC at 25° C. and at 75° C. for times of 60 seconds and 180 seconds. It is noted that the surface coloration of these samples changed as the voltages were increased. This change appears to be related to the thickness of the electroformed surface layer. Also the electrical resistance of the surface seems directly related to the voltage and time, with increasing resistance and thickness resulting from increased voltage and time. The resistance of the surface was measured by placing two metal probes from an ohmmeter onto the surface of the aluminum. Samples treated below 150 V AC showed conductive readings even on a 1 ohm full scale position indicating a discontinuous or delicately thin coating. Samples treated above 150 V AC started to show resistive readings when the probes were gently laid on the surface but conductive readings were observed when the probes were pressed into the surface as if they were breaking through a dielectric layer. This layer resistance read off the high resistance side of the scale even with the meter switched to a full scale 100,000 ohm position. The resistance noted is apparently analogous to the type of insulating features generally associated with electrical oxidation (anodization of aluminum) and suggestive of a unique process for producing dielectrics for use in various electrical applications which would compare favorably with commercial methods. Examples of this potential use include capacitors of the types used in the semiconductor industry wherein this process offers advantages in uniformity and performance which can be very important.

Some of the sample plates provided with a surface layer by way of the electrolytic process of Example V were selected at random and coated with a diazo resin layer and subjected to the "breakdown" test referred to in Example I. All the samples tested were rated as excellent.

TABLE IV

| Test No. | Voltage AC (volts) | Time (sec.) | Temp. (°C.) | Second Electrode | Surface Electrical Properties |
|---|---|---|---|---|---|
| 1 | 30 | 60 | 25 | Aluminum | Conductive |
| 2 | 60 | 60 | 25 | Aluminum | Conductive |
| 3 | 100 | 60 | 25 | Aluminum | Conductive |
| 4 | 120 | 60 | 25 | Aluminum | Conductive |
| 5 | 150 | 60 | 25 | Aluminum | Borderline |
| 6 | 200 | 60 | 25 | Aluminum | Resistive |
| 7 | 220 | 60 | 25 | Aluminum | Resistive |
| 8 | 30 | 60 | 75 | Aluminum | Conductive |
| 9 | 60 | 60 | 75 | Aluminum | Conductive |
| 10 | 100 | 60 | 75 | Aluminum | Conductive |
| 11 | 120 | 60 | 75 | Aluminum | Conductive |
| 12 | 150 | 60 | 75 | Aluminum | Resistive |
| 13 | 200 | 60 | 75 | Aluminum | Resistive |
| 14 | 220 | 60 | 75 | Aluminum | Resistive |
| 15 | 100 | 180 | 25 | Aluminum | Conductive |
| 16 | 150 | 180 | 25 | Aluminum | Resistive |
| 17 | 200 | 180 | 25 | Aluminum | Resistive |
| 18 | 100 | 180 | 75 | Aluminum | Borderline |
| 19 | 150 | 180 | 75 | Aluminum | Resistive |
| 20 | 200 | 180 | 75 | Aluminum | Resistive |
| 21 | 220 | 180 | 75 | Aluminum | Resistive |

Figure 10:
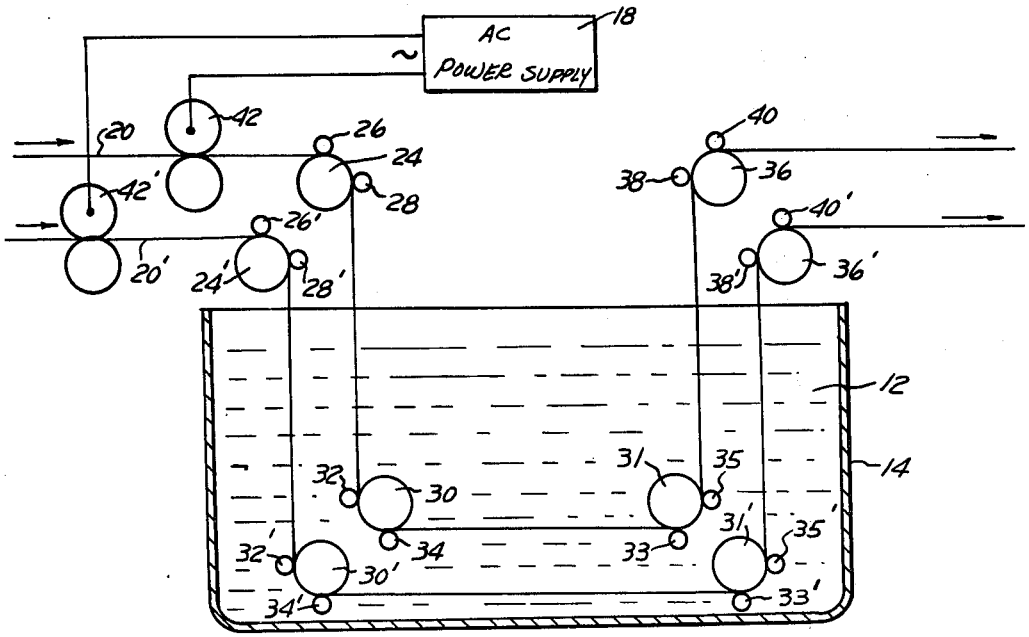
FIG. 10 is a schematic representation of a further modification of the arrangement of FIG. 8 showing a continuous line process.

By utilizing an AC power supply a continuous line process has been devised, schematically represented at FIG. 10, having two continuous metallic webs, or strips of, for example, aluminum, as shown at 20 and 20', arranged to be dipped into a tank 14 containing an appropriate electrolyte 12 by means of adequate deflecting drive roller assemblies 24–26–28 and 24'–26'–28' respectively. The two webs are displaced substantially parallel to each other within the electrolyte by means of roller assemblies 30-32-34 and 31-33-35, and 30'-32'-34' and 31'-33'-35', respectively. One of the webs, for example web 20 is connected by means of an appropriate contact making current conductive roller 42 or any other appropriate means to a terminal of the AC power supply 18, while the other web 20' is connected by means of current conductive roller 42', or any other appropriate means, to the other terminal of the power supply. If one surface of each web is grained, the grained surfaces are disposed opposite to each other. The electrolyte compositions, concentrations and temperatures, the distance between the webs while being translated within the electrolyte, the duration of immersion of the webs are generally quite alike such variables as used in the DC electrolytic process of the invention, while the AC voltages (RMS) are preferably slightly higher than the preferred DC voltages.

After passage through the electrolytic bath the metallic plate 10, as shown schematically at FIG. 4, is provided with a DC or AC electrolytically formed surface barrier layer 50, preferably only on one surface thereof if the plate 10 is to be used, after coating with an appropriate photo-sensitive material, in photo-lithography and the like. It is obvious that with the arrangement of FIGS. 2 and 9 the metallic plates are generally provided with a layer on both faces thereof and that a certain amount of the layer has been formed also on the edges of the plates.

Electro-silicated metallic plates, in view of the electro-silicated surface providing an electrically resistant and corrosion resistant surface can find general applications in many industries. Electro-silication of metallic surfaces may be used as a corrosion inhibition step instead of or before applying paint, lacquer or the like to a metallic surface.

When the electro-silicated plate has been treated according to any one of the processes of the present invention for purpose of providing a support member for a lithographic plate or the like, the silicated surface 50, as shown at FIG. 5, is coated with a diazo resin 52, or the like, the silicated layer 50 providing, as previously mentioned, a good anchoring surface for the photosensitive diazo material or the like and a generally hydrophilic surface, substantially resistant to the attack of fountain solutions when the plate, after processing, is placed in a conventional printing process. The electro-silicated surface described herein may be applied to a metallic element which has sufficient rigidity to act as its own support, or an electro-silicated surface may be applied to a thin metallic element, such as aluminum foil, which is in turn bonded onto a support structure.

Having thus described the present invention, by way of several examples of the methods for practicing the invention, what is claimed and sought to be protected by United States Letters Patent is as follows:

1. In a method for electrolytically forming a relatively hydrophilic layer on a surface of a metallic element consisting principally of aluminum consisting of disposing a pair of electrodes in contact with an electrolyte, said metallic element being at least one of said electrodes, and electrically connecting said electrodes across a supply of electricity for electrolytically forming on said metallic element said layer which comprises anions of said electrolyte reacted at the surface of the metallic element, the improvement consisting in dipping said electrode in an electrolyte consisting of an alkaline aqueous solution of sodium silicate containing from about 0.5 percent to about 37 percent per weight of sodium silicate, maintaining said electrolyte at a temperature between 25° C. and the boiling temperature of said electrolyte, maintaining said electrodes in said electrolyte within a distance of less than about 100 mm from each other for a duration of less than 180 seconds and connecting said electrodes to a source of alternating current of a voltage of about 9 to 220 volts.

2. The method of claim 1 wherein a layer is formed on a surface of each of a pair of metallic elements, each metallic element being one of said electrodes.

3. The method of claim 1 wherein each metallic element is in the form of a continuous web translated through said electrolyte.

4. The method of claim 1 wherein the aqueous solution of sodium silicate contains from about 0.5 percent to about 15 percent by weight of sodium silicate.

5. The method of claim 1 wherein the metallic element has at least a surface which is grained, said surface being disposed opposite the other electrode in the electrolyte.

6. The method of claim 1 wherein said metallic element is in the form of a continuous web translated through said electrolyte.

* * * * *

UNITED STATES PATENT AND TRADEMARK OFFICE

CERTIFICATE OF CORRECTION

PATENT NO. : 4,166,777

DATED : September 4, 1979

INVENTOR(S) : Edward A. Casson, Jr., et al

It is certified that error appears in the above-identified patent and that said Letters Patent are hereby corrected as shown below:

Column 8, line 25, "10" should be --18--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*